United States Patent [19]

Di Rosa

[11] Patent Number: 4,959,020

[45] Date of Patent: Sep. 25, 1990

[54] ELECTRICAL CONNECTOR SYSTEM FOR AUTOMATED STORAGE

[75] Inventor: Gaetano Di Rosa, Pino Torinese, Italy

[73] Assignee: Fata Automation S.p.A., Turin, Italy

[21] Appl. No.: 304,536

[22] Filed: Jan. 31, 1989

[30] Foreign Application Priority Data

Feb. 8, 1988 [IT] Italy ..... 19341 A/88

[51] Int. Cl.[5] ..... H01R 13/60

[52] U.S. Cl. ..... 439/138; 62/240

[58] Field of Search ..... 439/131, 132, 137, 138, 439/139, 140, 141, 142; 312/223, 320; 219/337, 361; 62/240, 295, 297, 237, 448, 243, 239, 457

[56] References Cited

U.S. PATENT DOCUMENTS

| | | | |
|---|---|---|---|
| 1,497,353 | 6/1924 | Woernley | 439/132 |
| 2,278,280 | 3/1942 | Pfeiffer et al. | 439/138 |
| 3,225,822 | 12/1965 | Westling | 62/240 X |
| 3,537,379 | 11/1970 | Hirai et al. | 62/237 X |
| 3,592,019 | 7/1971 | Beaudet | 62/297 X |
| 4,356,702 | 11/1982 | Kuttel | 62/240 X |
| 4,694,379 | 9/1987 | Unger et al. | 439/140 X |
| 4,738,117 | 4/1988 | Takasugi | 62/448 X |

FOREIGN PATENT DOCUMENTS

| | | | |
|---|---|---|---|
| 1163400 | 6/1985 | U.S.S.R. | 439/142 |

*Primary Examiner*—William Briggs

*Attorney, Agent, or Firm*—Finnegan, Henderson, Farabow, Garrett & Dunner

[57] ABSTRACT

In a system for the automated storage of refrigerated containers, of the type in which the containers are handled automatically within a cellular store, each cell and each container are provided with respective automatic quick plug-in means for connecting the container to at least one energy source. Preferably, for connection to a source of electrical energy, said automatic quick plug-in means can consist of a stationary contact provided on the rear wall of the container and a mobile contact provided on a support means on the cell; between said fixed and mobile contacts there also being provided means arranged to align the mobile contact with the fixed contact on positioning the container in the respective cell.

7 Claims, 7 Drawing Sheets

ELECTRICAL CONNECTOR SYSTEM FOR AUTOMATED STORAGE

This invention relates to a high-capacity large-cycle storage system for containers for transporting and preserving food or other products which need to be stored and maintained under certain preservation conditions which are constant with time. As is well known to experts of the art, said containers may be provided with self-contained electrically powered refrigeration units (or alternatively are directly refrigerated with fluid from an external system). The system according to the invention is able to automatically store the containers, automatically provide the required energy and control their continuous operation, enable the store environment to be maintained at normal climatic conditions, enable a container in which the preservation conditions are altering to be withdrawn in good time, and enable individual containers to be handled without disturbing the surrounding ones.

This system allows versatile working in that the containers represent at one and the same time both mutually independent cold-room units which can be statically stored, and cold-rooms able to travel on the road, sea etc.

In the storage and transportation of the different products which require particular preservation conditions there is a considerable need for rationalisation and automation to improve overall management and reduce the added cost to the product, i.e. a considerable interest in incorporating into the overall plant a series of industrial requirements which are of particular relevance to the food sector (but not limited thereto). The aforesaid requirements can be summarised as follows:

containing and stowing products (food products) in suitable means which in passing from the production centre to the distribution centre by way of the storage centre do not require manual handling of the product, numerous transfers with exposure of the product to normal atmospheric conditions, or change of containing means (each of these conditions involving high risks and additional costs);

preserving the product under specific temperature, humidity and hygienic conditions which remain constant with time and which if not respected can lead to loss of the product;

handling and storing said goods by computer-controlled, automated mechanised systems, because said means are of considerable weight and volume and any additional handling operation involves risks of errors and accidents;

the availability of sufficient areas for storing large product quantities at "strategic" points (or zones) for the required time;

storage of large volumes on small areas with consequent utilisation of available height.

So-called "cold stores" are known in which the product is assembled onto pallets or inserted into various types of non-thermally insulated containing means, which are then stowed on conventional multi-storey shelving, which is served by automatic handling machines of the traverser lifter type, or served by special trucks driven by personnel suitably protected against the low temperature.

These traverser lifters allow a considerable handling frequency, and a high level of automation in their management. The infill walls of the cold store have to be suitably insulated to keep the entire environment at the required temperature. Again, if the products to be stored are not homogeneous it is necessary to provide internal areas of different conditions, with separation systems between one area and another, which makes construction and general management more complicated.

Moreover, if the local temperature has to be low, the structure, machines and electrical-electronic appliances must be constructed for critical conditions.

However, such a storage system is "static" and is usually used for long periods of preservation, it being specifically suitable for the formation of strategic marketing or seasonal stocks.

When the product is to be withdrawn from the store for its transfer, it must be manually handled and transferred into means suitable for its transportation and preservation.

Experts of the art are also familiar with container storage systems which are more strictly stacking or depositing systems. These are in the form of deposits of containers on large spaces on which they are arranged next to each other on various levels, for example up to seven levels. The containers are handled by large portal or gantry cranes. Although said systems are mechanised, they have considerable limitations such as poor automation and difficulty in management linked to the impossibility of moving an individual container. The amount of work required to withdraw a container surrounded on all sides by others is considerable. The amount of individual movement, i.e. individual "insertions" and "withdrawals", is obviously very small even if the cranes are fast, because of the large number of manoeuvres required to free the container concerned.

Energy must be connected to each container manually, with great difficulty and loss of time.

Highly automated high-capacity, high-productivity container storage systems are known in which individual container movement is possible in that said systems comprise suitable shelving and mechanised internal handling systems.

However, even stores of this type have the drawback that if the containers are of refrigerated type the energy must be connected to each container manually.

The containers considered by the invention are of the so-called refrigerated type and therefore must either incorporate a self-contained refrigeration plant or be arranged for the forced circulation of refrigerant fluid provided by an external plant (in this case only fluid inlet and outlet ports are provided instead of the self-contained unit). The so-called self-contained refrigerated containers comprise a refrigeration unit which can be either powered directly by the mains or connected to their own diesel system. However for their storage, international standards require that only the mains-powered aspect is taken into consideration and not the diesel unit aspect. For their connection to the mains the containers are provided with at least one electrical connection cable with a connector at its free end, the cable being wound into a coil and housed in a suitable compartment in the container.

The electrical equipment must be powered at a certain predetermined voltage, for which the end connector on the cable is of a certain form. The electrical equipment can also be suitable for two operating voltages, in which case there will be two separate cables with relative connectors. These cables can obviously only be handled manually.

The containing means under consideration is that universally known as a CONTAINER or TEU, i.e. a transport equivalent unit, and its multiples, and specifically of the refrigerated type for preservation at positive or negative temperature.

The storage system is a multi-storey load-bearing structure which enables an individual container to be deposited in one of its cells, and is provided with specific handling systems.

Small and medium volumes of product can be disposed on pallets or in containing cages or baskets to form freight units which are then inserted into containers, in which the correct temperature and humidity conditions for preservation are maintained.

In the light of the aforegoing the overall object of the present invention is to obviate the drawbacks and/or limitations of the known art by providing a system for storing containers in a completely automatic manner, the system being able to satisfy the aforesaid operating requirements.

This object is attained according to the invention by a system for the automated storage of refrigerated containers, of the type in which the containers are handled automatically within a cellular store, characterised in that each cell and each container are provided with respective automatic quick plug-in means for connecting the container to at least one energy source. In this manner, on inserting each container into the respective cell, it becomes automatically connected to an energy-carrying part or parts suitable for maintaining the required temperature and humidity conditions.

Said automatic quick plug-in means for connection to a source of electrical energy can comprise a first contact mounted on the rear wall of the container and a second mobile contact mounted on a support on the cell, between said two contacts there acting mutual alignment means.

Preferably, said first contact is mounted on a rotatable door provided on said container rear wall, said second contact being mounted self-adjustable in position, in cooperation with the first, on said support provided on the cell, said support also comprising means for automatically opening said door on inserting the container into the cell, said mutual alignment means consisting of cam elements.

From the aforesaid it is apparent that the proposed system, which is totally automated and suitable for fresh, frozen or deep-frozen food products, is particularly innovatory in that it represents a multi-purpose refrigerator store formed from cold-room units represented by the refrigerated containers individually inserted into the individual cells, which containers can be transported without the product requiring to be variously and manually handled in its transfer from the static storage condition to the transportation condition and vice versa.

Consequently, the containing means (travelling cold-room) remains a cold-room by the fact of it being possible to connect it to the electricity mains by suitable automatic devices.

The system thus formed is flexible in that each container can be under its own required temperature and humidity conditions without influencing the other containers, this being impossible or only partially possible with those systems in which it is the store itself which is refrigerated.

The store can therefore be viewed as a structure which does not require its outer sides to be infilled.

The structural and operational characteristics of the invention and its advantages compared with the known art will be more apparent from the detailed description given hereinafter with reference to the accompanying diagrammatic drawings, which illustrate a non-limiting example of a storage system incorporating the principles of the invention. In the drawings.

Figure 1:
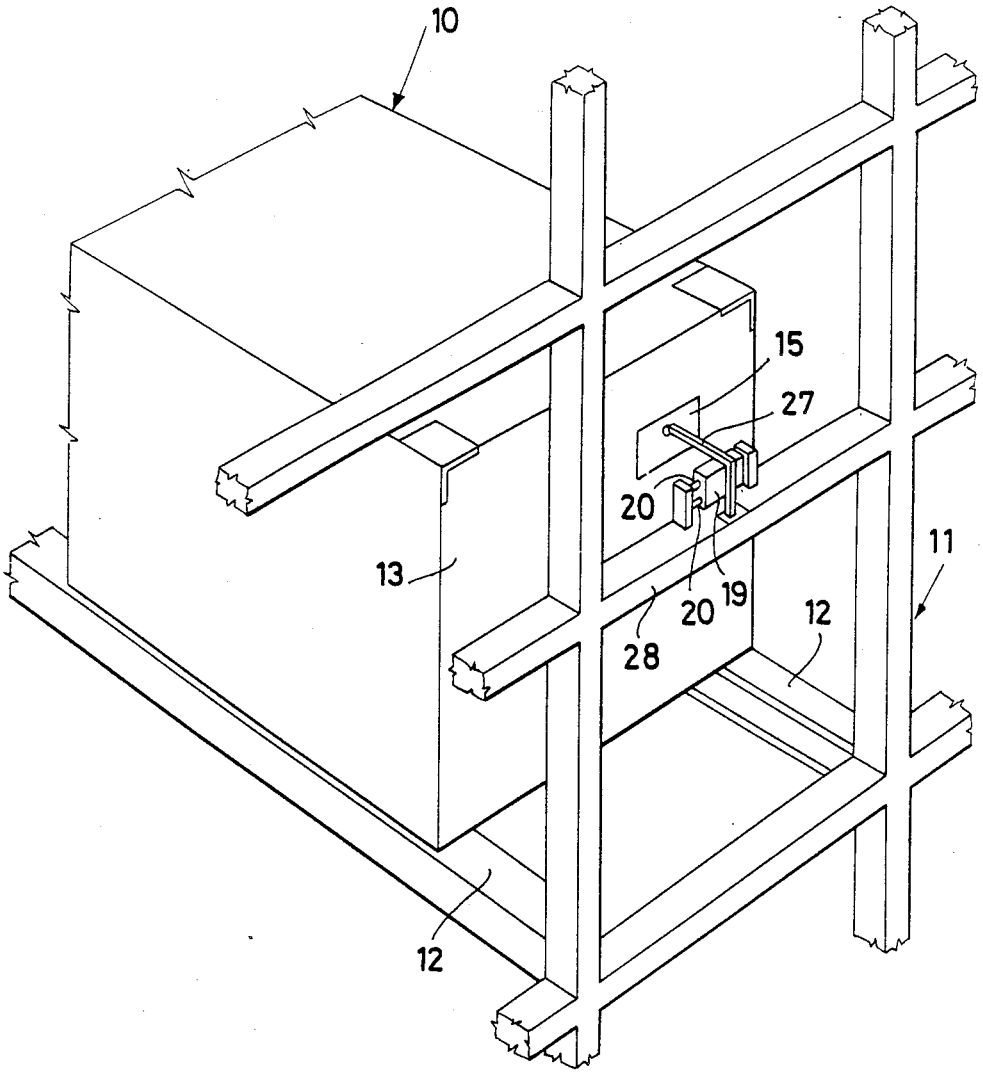
FIG. 1 is a perspective view illustrating the stage in which a container is housed in a cell in accordance with the system according to the invention.

In FIG. 1 of the drawings, the reference numeral 10 indicates overall a refrigerated container of known type, and 11 indicates a cell of an automatic store, also of known type, in which the container is to be housed, resting on guides 12.

According to the present invention, the rear wall 13 (with respect to the cell) of the container 10 and the cell 11 comprise respective automatic quick plug-in means for connecting the container to at least one energy source, such as a source of electrical energy (not shown on the drawings).

Said automatic quick plug-in means are shown diagrammatically by way of example, but such as to be able to be implemented by an expert of the art, in FIGS. 2 to 5 and FIG. 10 of the drawings.

By way of non-limiting example, the rear wall 13 of the container 10 can comprise an aperture 14 closed by a door 15, which can be mounted in the aperture 14 by a swivel system with known balancing springs and indicated overall by 16.

On the inner face of the door 15 there is fixed a first electrical contact 17 arranged to cooperate with a second electrical contact 18 mounted with automatically adjustable positioning on a support on the cell 11.

Figure 5:
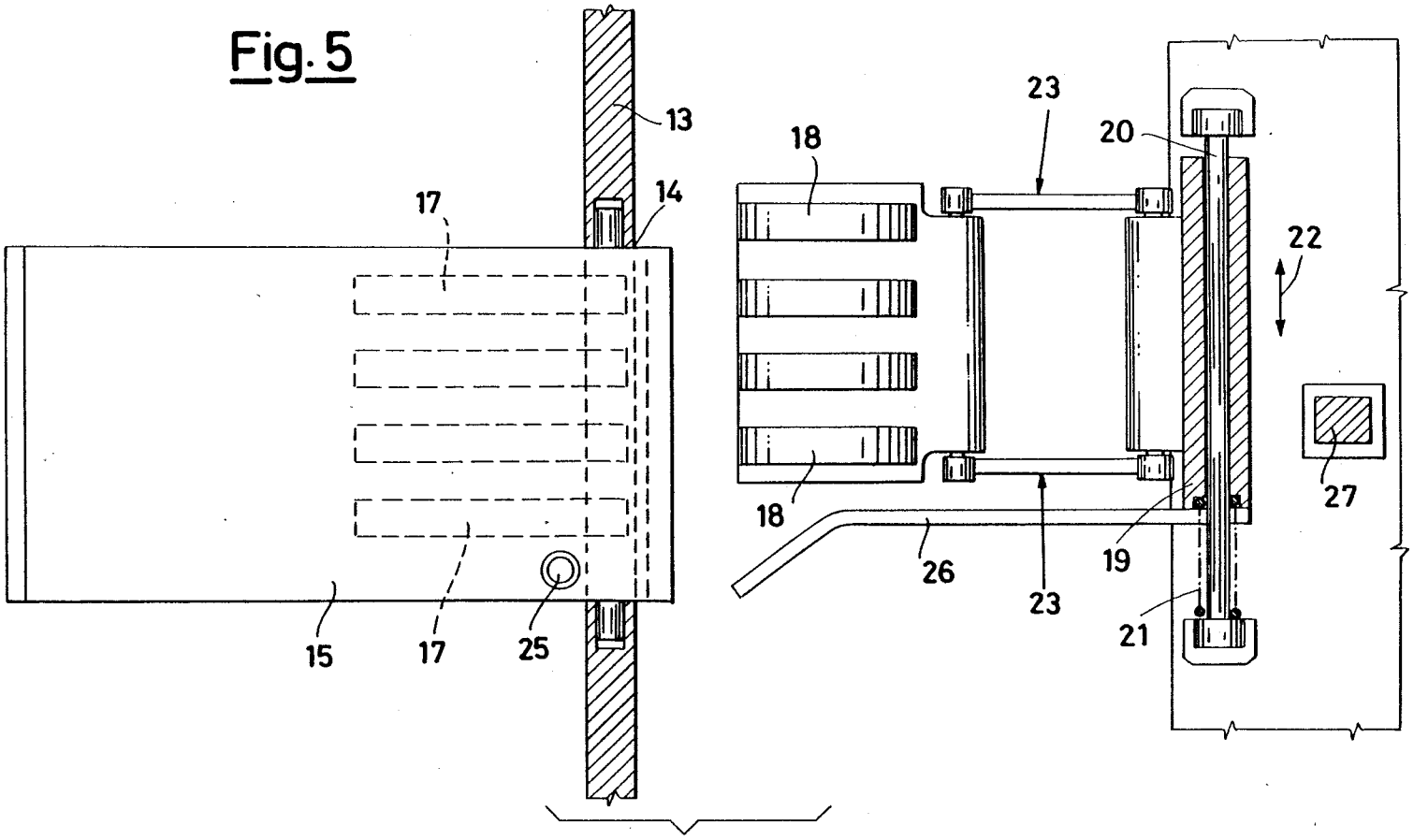
FIG. 5 is a plan view of the contacts of FIGS. 2 to 4 in their open state.

More precisely, said second contact 18 is carried by a slider 19 slidable on guides 20 against the action of a return spring 21 which tends to always keep it in the position shown in FIG. 5 of the drawings. In this manner, the position of the contact 18 can be aligned, as described hereinafter, by displacement in the two directions of the arrow 22 of FIG. 5.

Figure 2:
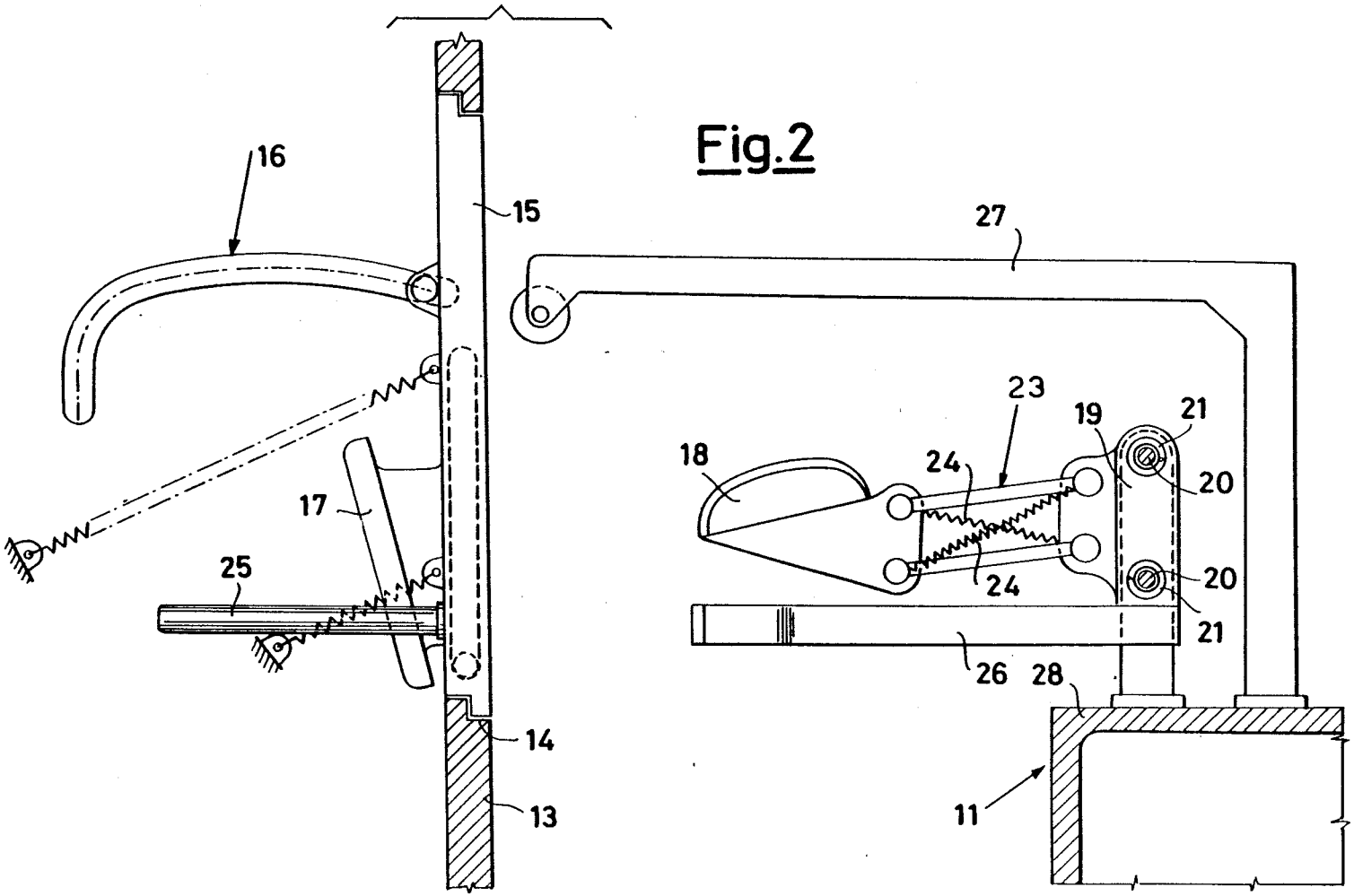
FIGS. 2 to 4 are vertical sectional detailed views illustrating the stage in which the fixed and mobile contacts provided respectively on the rear wall of the container and on a beam of the relative store cell are engaged with each other.

The contact 18 is spring-mounted on the slider 19 by a pantograph comprising a pair of lateral articulated parallelograms 23 with return springs 24 which tend to keep the pantograph in the raised position shown in FIG. 2.

A cam system comprising a pin extending from the door 15 cooperates with the electrical contacts 17, on said cam there acting a shaped guide 26 fixed to the slider 19.

A push rod 27 extending from a beam 28 of the cell 11 cooperates with the door 15 in order to open it, said beam carrying the entire contact assembly 18.

The operation of the described system is apparent from the operational sequence shown in FIGS. 2 to 5 of the drawings and is briefly as follows.

Figure 3:
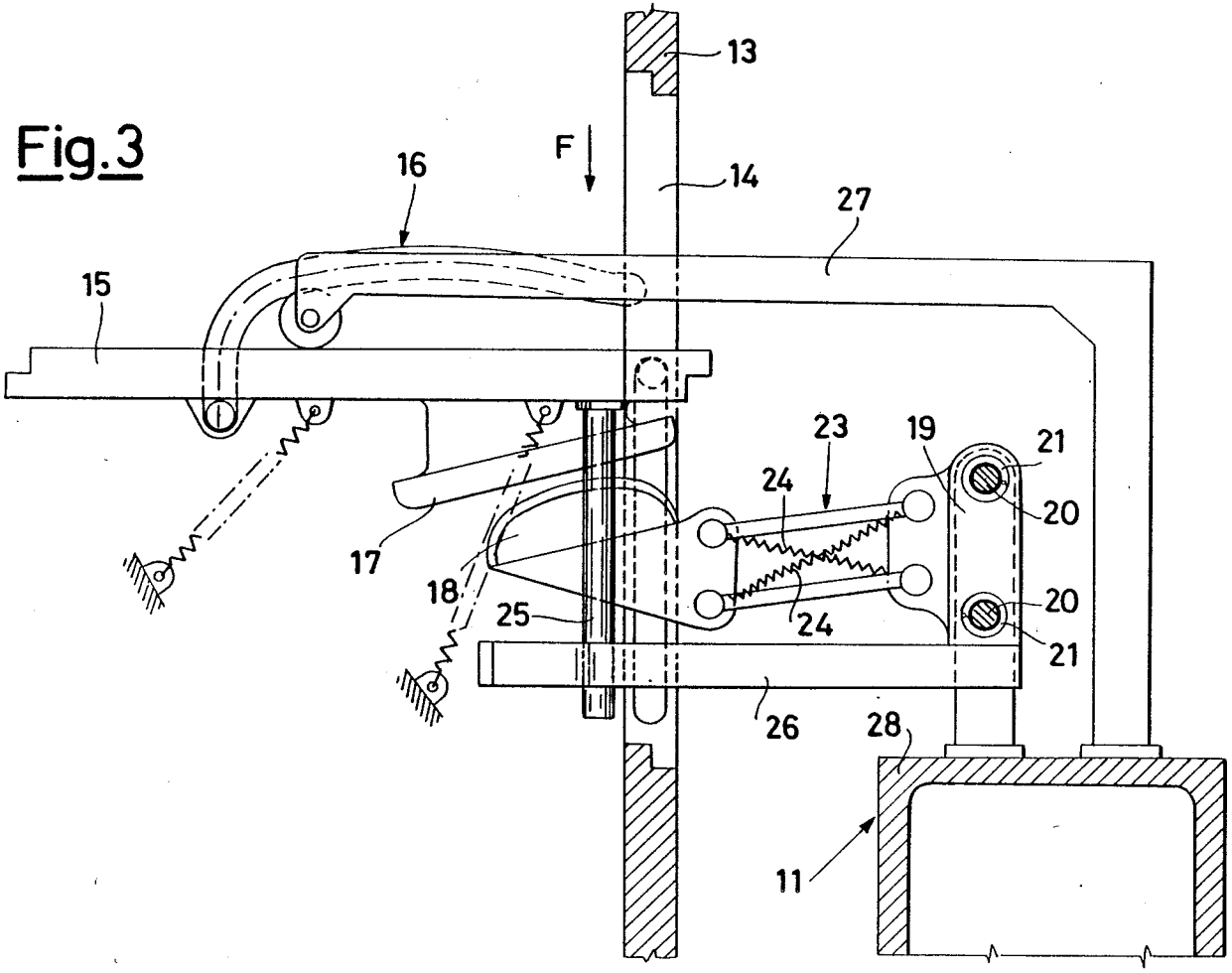

When a container 10 is inserted into a relative cell 11, the push rod 27 automatically opens the door 15 by rotating it in an anticlockwise direction into the position shown in FIG. 3, in which the contact 17 lies above the contact 18 but spaced from it because, as is well known to experts of the art, the container 10 during its insertion into the cell 11 rests on the vertically mobile platform of a container transfer means (shuttle), the platform descending when having reached its end-of-travel position to deposit the container 10 on the guides 12.

Figure 4:
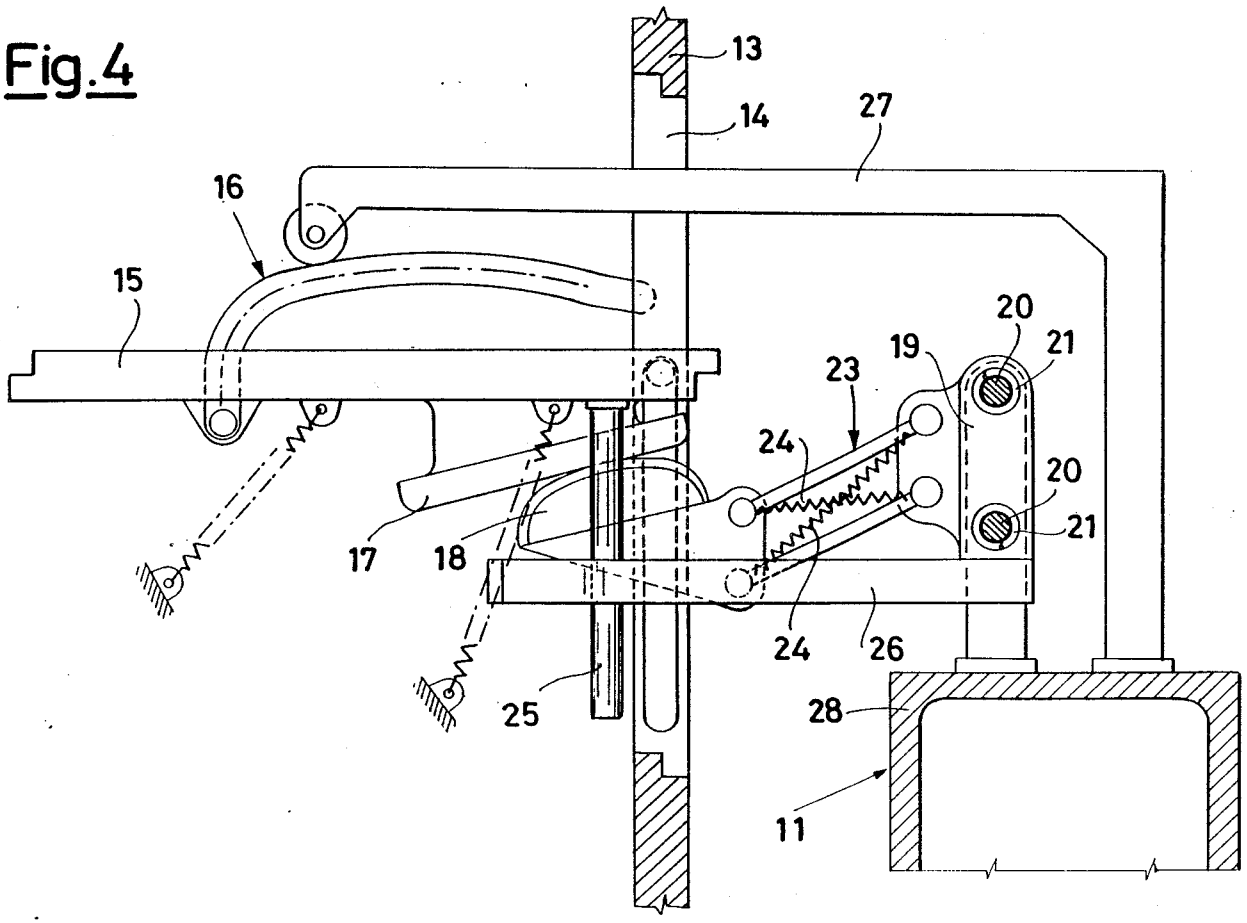

When the container 10 is lowered in this manner, in the direction of the arrow F of FIG. 3, and rests on the guides 12 the contacts 17, 18 mutually engage as shown in FIG. 4 to provide an electrical connection between a central source of electrical energy in the store and the refrigeration unit (not shown) provided in each container 10.

It should be noted that any small alignment errors between the contacts 17, 18, deriving from possible errors in the stoppage position of the traverser-lifter means which handles the container 10, are taken up by the system formed from the pin 25 and cam 26 which moves the slider 19 on which the contact 18 is mounted. FIGS. 6 to 9 show the case in which two containers 29 of one half the length of the container 10 are stored (in this respect the containers used are of 40 ft and 20 ft in length). For this purpose, characteristically, each cell 11 comprises a pair of contacts 18 heretofore described with reference to FIGS. 1 to 5. A first contact 18 is provided, as stated, on the rear of the cell while a second contact 18 is provided on the cell roof and is carried by a swivel arm 30.

Figure 6:
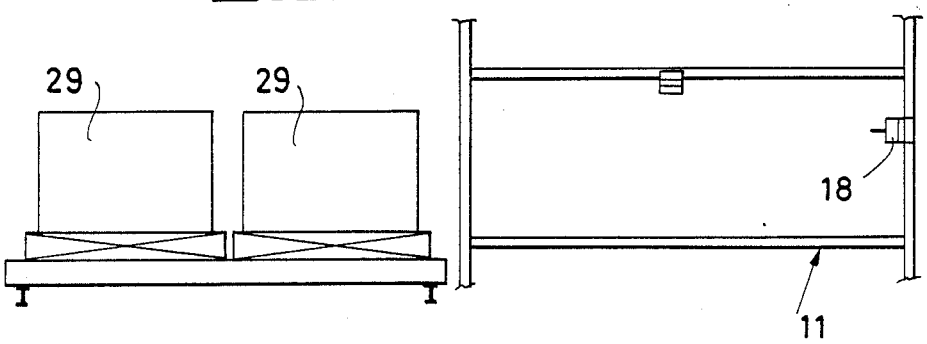
FIGS. 6 to 9 are diagrams showing the method for housing two smaller containers in the same cell.
Figure 7:
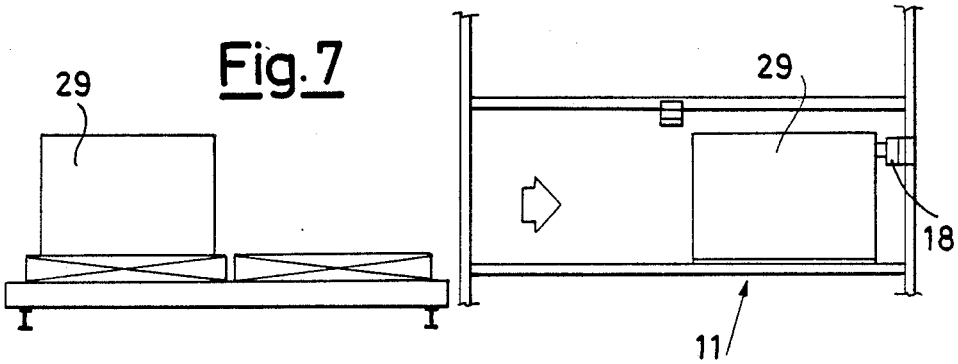
Figure 8:
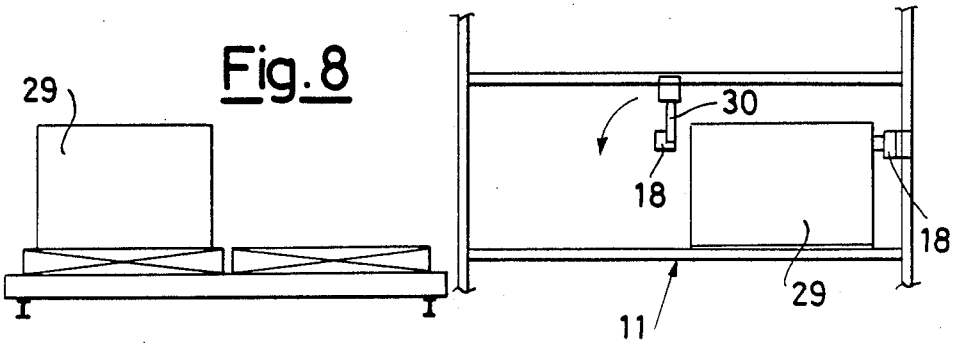
Figure 9:
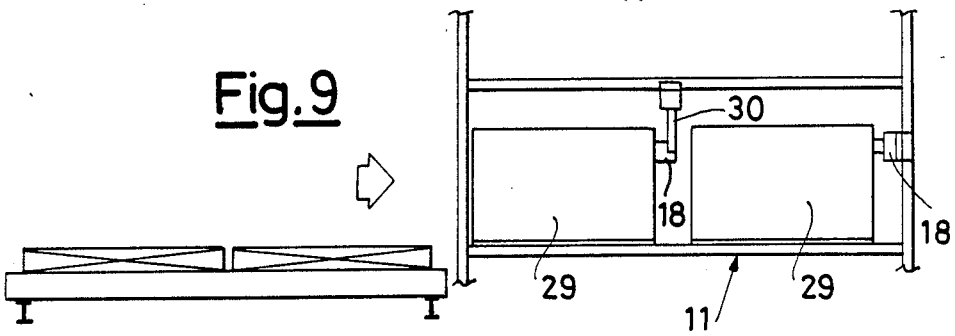

In this manner it is apparent that the contact 18 carried by the swivel arm 30 can be displaced from the non-operating position shown in FIGS. 6 and 7, in which it is outside the insertion path of the first container 29, to the lowered operating position shown in FIGS. 8 and 9, in which the contact 18 can engage the contact 17 provided on the door 15 of the second container inserted after the first.

Figure 10:
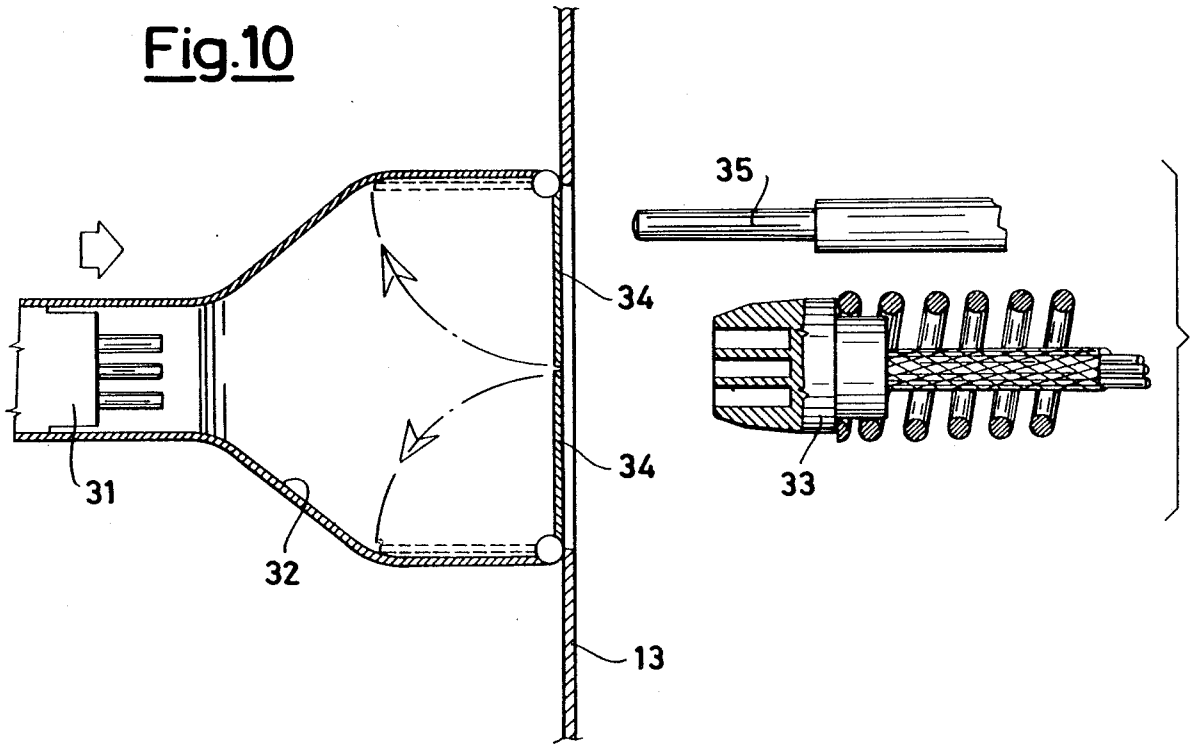
FIG. 10 shows a further possible embodiment of the invention.

FIG. 10 of the drawings shows a possible modification of the invention in which the contacts 17, 18 are replaced respectively by a fixed electrical plug 31 mounted in a seat 32 provided on the rear wall 13 of the container, and a flexible electrical socket 33 provided at the rear of the cell 11.

In a like manner to the previously described embodiment, the seat 32 is closed by a two-panel door 34 which can be opened by a push rod 35 projecting from the rear of the cell 11.

According to the invention, both the container and the cell can be provided with a plurality of the aforesaid automatic quick plug-in means for connecting the container to electrical energy sources of different voltages.

In a storage system of the aforesaid type, containers which are not provided with said means for automatic connection to a central electricity source can also be housed, in the following two ways.

(1). By keeping some of the cells at ground level available for use, so that the necessary manual operations will not be too difficult.

(2) By providing some of the cells with connection devices identical to the aforesaid and mounted in a suitable position, and fitting those other containers with an interface module which allows automatic connection. Said module can for example consist of a frame which is to be fixed to the container in a suitable manner and is provided with two connectors, namely a first movable connector for the existing power cable and a second connector fixed on the module to make the automatic connection in the cell. The modules would be kept available in the container reception zone, in which it would be a simple matter to mount them on the relevant end of the respective container.

The interface module can likewise be provided with the necessary interconnections for any containers which do not possess a self-contained unit but instead use circulated refrigerant fluid produced by a central generator available in the store.

From the aforegoing it is apparent that rational and functional handling and storage of containers within a known system offering the aforesaid advantages, according to the invention, has been obtained by the necessary overcoming of the not indifferent obstacle represented by the operation involving the connecting of energy between each individual container and the fixed distribution system, it being impracticable to carry out this operation manually in each individual cell.

I claim:

1. A storage system for self-refrigerated containers of the type in which the containers are housed in a cell of a cellular store, which system comprises:

(a) at least one self-refrigerated container having at least one first electrical contact means for connecting a refrigeration unit therein to an external electric power source;

(b) a corresponding cell for housing said container, said cell having a support member provided with at least one second electrical contact means for connecting said electric power source to said first electrical contact means and having guide means for supporting said container in said cell;

(c) said first and said second electrical contact means being positioned in said container and said cell, respectively, so that when said container is inserted in said cell and rests on said guide means said electrical contact means mutually engage for providing an electrical connection between the external electric power source and said refrigeration unit.

2. The storage system of claim 1, wherein said container has a rear wall and said first electrical contact means comprises a first contact mounted on said rear wall, said second electrical contact means comprises a second contact mounted on said support member, and there is further included means for aligning said contacts when said container is inserted in said cell to rest on said guide means.

3. The storage system of claim 2, wherein said first contact is mounted on a rotatable door provided on said container rear wall, said second contact is movably mounted on said support member, said aligning means comprises a cam system and there is further included on said support member means for automatically opening said door when said container is inserted into said cell.

4. The storage system of claim 2, wherein said second contact comprises an electrical plug flexibly mounted on said support member and said first contact comprises a complementary electrical socket.

5. The storage system of claim 1, wherein said cell comprises front and rear portions, and said first electrical contact means comprises a first fixed electrical contact mounted on said rear portion and a second moveable electrical contact positioned intermediate said front and rear portions, said second electrical contact being moveable between a first non-operative position outside the path taken by a container during its insertion into the cell and a second operative position within said path, so that when said second moveable contact is in said first non-operative position a first container can be inserted into the cell to engage said first fixed electrical contact, after which said second moveable electrical contact can be moved into said second operative position ready to engage a second container inserted in said cell.

6. The storage system of claim 3, wherein said aligning means comprises a pin member mounted on said rotatable door, and a slider member slideably mounted on said support member, a shaped guide member affixed to said slider member, and wherein said second contact is mounted on said slide member, said shaped guide member cooperating with said pin member to cause said second contact to become aligned with said first contact when said container is inserted in said cell.

7. The storage system of claim 6, wherein said second contact is spring mounted on said slider through a pantograph.

* * * * *